United States Patent [19]

Tietjens

[11] Patent Number: 4,707,923

[45] Date of Patent: Nov. 24, 1987

[54] SHAVING APPARATUS

[75] Inventor: Eduard W. Tietjens, Drachten, Netherlands

[73] Assignee: U.S. Philips Corporation, New York, N.Y.

[21] Appl. No.: 824,027

[22] Filed: Jan. 30, 1986

Related U.S. Application Data

[63] Continuation of Ser. No. 622,505, Jun. 20, 1984, abandoned.

[30] Foreign Application Priority Data

Jun. 23, 1983 [NL] Netherlands ..... 8302234

[51] Int. Cl.[4] ..... B26B 19/04

[52] U.S. Cl. ..... 30/346.51; 30/43.6

[58] Field of Search ..... 30/346.51, 43.4, 43.5, 30/43.6

[56] References Cited

U.S. PATENT DOCUMENTS 4,240,199 12/1980 Boiten et al. ..... 30/346.51 X
4,259,781 4/1981 Boiten et al. ..... 30/346.51 X
4,272,884 6/1981 Tietjens ..... 30/346.51 X
4,281,453 8/1981 Bakken et al. ..... 30/346.51 X

*Primary Examiner*—Paul A. Bell
*Assistant Examiner*—William Fridie, Jr.
*Attorney, Agent, or Firm*—Thomas A. Briody; William J. Streeter; Rolf E. Schneider

[57] ABSTRACT

A shaving apparatus comprises a first cutting member having a circular central body, and a second cutting member having a wall provided with hair-entry apertures, the first cutting member being associated with and rotatable relative to the second cutting member. A plurality of blades is provided for engagement with the second cutting member. A plurality of resilient blade arms respectively connects the blades to the central body, each blade arm lying in a plane inclined in the direction of rotation of the first cutting member. Each blade arm is in the form of a leaf spring and extends in its longitudinal direction radially from the central body and in its lateral direction substantially along a helix extending both in the axial direction towards the second cutting member and in the direction of rotation.

2 Claims, 4 Drawing Figures

SHAVING APPARATUS

This is a continuation of application Ser. No. 622,505, filed June 20, 1984, now abandoned.

This invention relates to a shaving apparatus comprising a rotatable first cutting member having a central body provided with blades, and a second cutting member having a wall which is provided with hair-entry apertures, the first cutting member being coupled by means of a shaft to a driving mechanism to be rotatably driven thereby relative to the second cutting member, and at least one resilient element being interposed between the blades and the driving mechanism.

Such a shaving apparatus is known, for example, from U.S. Pat. No. 3,890,705.

The present invention has for its object to provide a construction which is simple and can therefore be manufactured at low cost and in which the friction losses between the two cutting members are small, but in which nevertheless during the hair-cutting operation the first cutting member is continuously in satisfactory engagement with the second cutting member.

The construction according to the invention is characterized in that the resilient element is in the form of a longitudnally straight leaf spring which in the longitudinal direction extends radially relative to the shaft and in the lateral direction extends substantially along a helix which extends both in the axial direction towards the second cutting member and in the direction of rotation.

The invention will now be described with reference to the accompanying drawings, in which.

Figure 1:
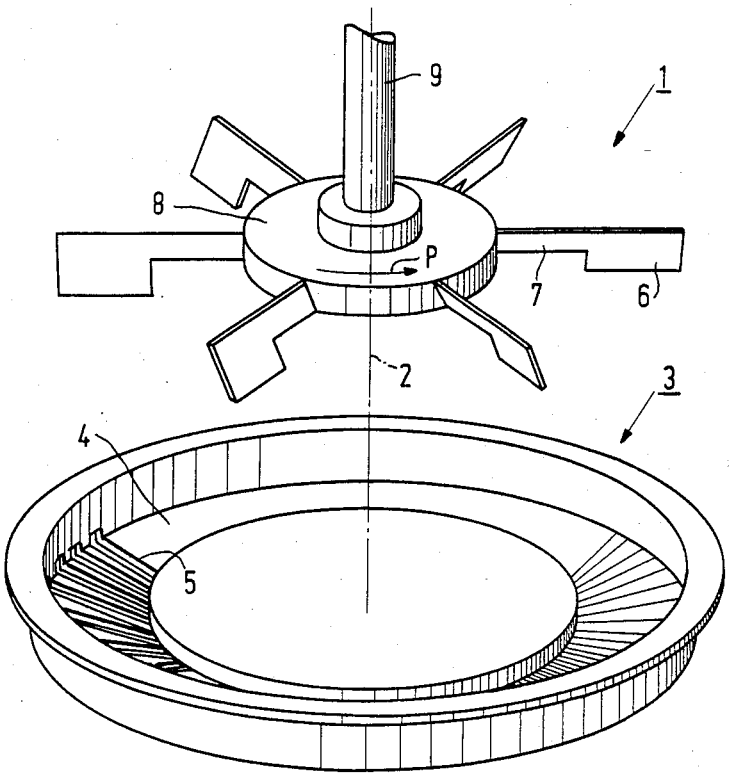
FIG. 1 is an exploded perspective view of a first cutting member and a second cutting member.
Figure 2:
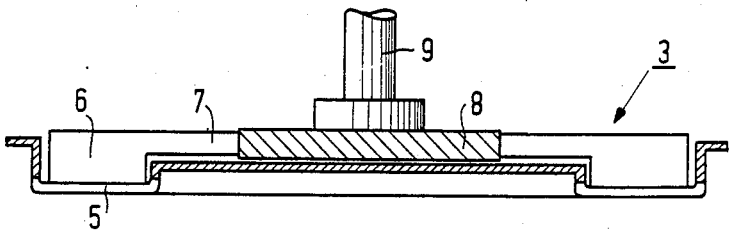
FIG. 2 is an axial sectional view of the two cutting members of FIG. 1 in assembled condition.
Figure 3:
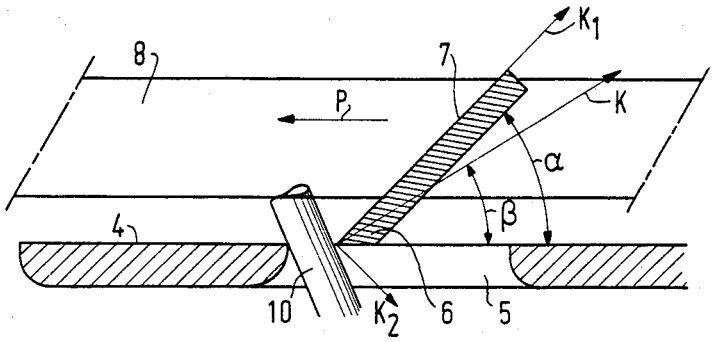
FIG. 3 is a sectional view on an enlarged scale showing parts of the two cutting members during the cutting of a hair, the section being taken in a plane at right angles to a radius of the first cutting member.

The first cutting member 1 in FIGS. 1 to 3 is arranged to be driven with a rotary movement about an axis 2 relative to the second cutting member 3. This second cutting member 3 comprises a wall 4 provided with hair-entry apertures 5. The first cutting member 1 has blades 6 which are respectively situated at or directly connected to the outer ends of the longitudinal blade arms 7 extending in a radial outward direction with respect to the axis of rotation 2. The inner ends of the blade arms 7 are respectively cnnected to a circular central body 8 fixed to the end of a shaft 9.

The cutting members 1 and 3 are component parts of a dry-shaving apparatus, the remainder of which, for the sake of simplicity, is not shown in the drawings, the first cutting member 1 being driven in known manner by means of a driving mechanism, for example, an electric motor, which is coupled to the shaft 9. When a hair protrudes through a hair-entry aperture 5, this hair will be cut off by a blade 6 in cooperation with the second cutting member 3.

The arms 7 are resiliently flexible so that with a slight deflection of these arms the blades engage the second cutting member 3 with a small force. The strength of this engagement force is chosen so that during the cutting of a hair the relevant blade 6 will mostly remain in contact with the second cutting member. However, in the event of a blade being subjected to an extraordinarily strong force during cutting, the blade can yield due to the resilience of its arm 7. Because of the resilience of the arms 7 there is no need for separate resilient elements for urging the first cutting member 1 against the second cutting member 3. It is important to keep the engagement force for each blade at a minimum because the overall engagement force exerted between the two cutting members is the sum of the engagement forces exerted by all the blades, and to limit to a minimum the amount of wear and the loss of energy due to friction.

Each resilient arm 7 is constructed as a leaf spring which extends in the radial direction relative to the axis of rotation 2 and which is flexible in directions at right angles to the plane of the leaf spring and rigid in directions parallel to this plane. In this way a construction in which a small engagement force is exerted between each blade and the second cutting member can be obtained in a simple manner. However, it is necessary to avoid the blades being pushed away from the second cutting member too rapidly by the forces occurring during cutting, since this would adversely affect the cutting action. For this purpose, each blade arm 7, which as already mentioned is constructed as a leaf spring, lies substantially in a plane which is inclined relative to the axis of rotation 2 so that in the lateral direction, i.e., the direction transverse to its longitudinal axis, the arm extends substantially along a helix which extends both in the axial direction towards the second cutting member and in the direction of rotation indicated by the arrow P. In the embodiment shown, each blade 6 is arranged in the same inclined plane as the associated blade arm 7.

The plane of each resilient blade arm 7 forms an acute angle $\alpha$ of, for example, 45° with the portion of the wall 4 of the second cutting member 3 which is immediately to the rear of the respective blade 6 with respect to the direction of movement P (FIG. 3). This angle is chosen so that in most cases it will be larger than the angle $\beta$ enclosed between said wall portion and the direction of the cutting force K exerted by a blade 6 when it meets a hair 10. This cutting force K has a component $K_1$ extending laterally along the blade arm 7 in the plane of the arm and a component $K_2$ extending at right angles to the component $K_1$. Each blade arm 7 has a high degree of rigidity in the direction of the component $K_1$ so that the deflection of the blade 6 in this direction will be small. Due to the low degree of rigidity in the direction $K_2$, this component of the force K keeps the blade 6 urged against the wall 4 during the cutting of the hair 10, which is the optimum position for cutting the hair.

The first cutting member 1, comprising the central body 8, the blade arms 7 and the blades 6, is preferably made in one piece from sheet material.

Since the blades 6 are individually resiliently supported, they will become disengaged from the wall 4 due to unevennesses in the surface of this wall less rapidly than if the blades were to form a rigid assembly with the blade arms and the central body. As a result, the accuracy requirements to be imposed on the manufacture of the second cutting member can be less stringent so that this component also can be manufactured at lower cost without adversely affecting the operation of the two cutting members.

Since the reaction force K occurs only when a hair is cut, only very small friction losses occur between the two cutting members because the engagement force between these two cutting members under no-load conditions need be only very small. This results in a smaller amount of wear and a lower generation of heat, while a smaller driving motor is sufficient.

In the case of a battery-powered apparatus or a rechargeable apparatus, the apparatus can be used many times before the batteries have to be replaced or the apparatus has to be recharged.

Figure 4:
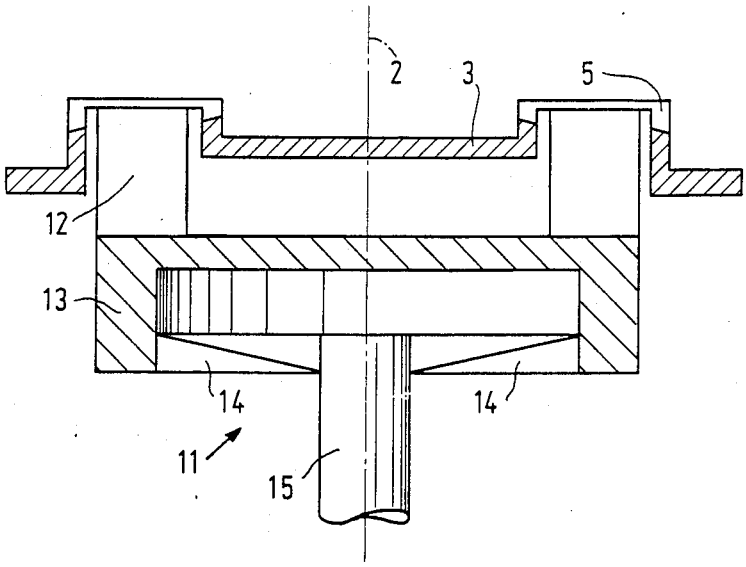
FIG. 4 shows diagrammatically a first cutting member and a second cutting member of another embodiment.

In the embodiment shown diagrammatically in FIG. 4, the second cutting member 3 with the hair-entry apertures 5 is identical to that of the embodiment shown in FIGS. 1 to 3. The rotatable first cutting member 11 is provided with blades 12 which are directly secured to a central body 13 and form with this body a rigid assembly. The central body 13 is coupled to a shaft 15 by three resilient arms 14 which are regularly distributed around the shaft. These resilient arms 14 have the form of leaf spring and are arranged so that in the lateral direction each arm extends substantially along a helix in a similar manner to the arms 7 in the embodiment shown in FIGS. 1 to 3. The arms 14 thus provide an engagement force which during the cutting of a hair urges the assembly of the blades 12 and the central body 13 towards the second cutting member. Since this engagement force occurs only when a hair is cut, in this embodiment also only small friction losses occur between the two cutting members under no-load conditions.

What is claimed is:

1. A shaving apparatus comprising a first cutting member having a circular central body; a second cutting member having a wall provided with hair-entry apertures, the first cutting member being associated with and rotatable relative to the second cutting member; a plurality of blades for engagement with the second cutting member; and a plurality of resilient longitudinally straight blade arms respectively connected at their inner ends to the circular central body and extending radially outwardly from such circular central body with respect to its axis of rotation, the outer ends of said longitudinally straight blade arms being respectively directly connected to the blades, each such longitudinally straight blade arm and its associated blade lying in a plane inclined in the direction of rotation of the circular central body; each blade arm being in the form of a longitudinally straight leaf spring extending in its longitudinal direction radially from the circular central body and in its transverse direction substantially along a helix extending both in the axial direction towards the second cutting member and in the direction of rotation; each such blade arm being flexible in directions at right angles to said inclined plane and rigid in directions parallel to said plane.

2. A shaving apparatus according to claim 1, in which the circular central body, the longitudinally straight blade arms, and the blades of the first cutting member are made in one piece from sheet material.

* * * * *